United States Patent [19]

Landoni

[11] 4,262,613

[45] Apr. 21, 1981

[54] APPARATUS FOR CONTROLLING THE TRANSVERSE MOVEMENT OF A FABRIC SUPPORTING CARRIAGE IN A QUILTING MACHINE

[75] Inventor: Giannino Landoni, Fagnano Olona, Italy

[73] Assignee: Meca, S.n.c., Cassano Magnago, Italy

[21] Appl. No.: 118,964

[22] Filed: Feb. 5, 1980

[30] Foreign Application Priority Data

Feb. 9, 1979 [IT] Italy ..... 20080 A/79

[51] Int. Cl.[3] ..... D05B 21/00

[52] U.S. Cl. ..... 112/118; 112/121.12

[58] Field of Search ..... 112/118, 119, 117, 121.11, 112/121.12

[56] References Cited

U.S. PATENT DOCUMENTS

| | | | |
|---|---|---|---|
| 3,960,095 | 6/1976 | Story | 112/118 |
| 4,201,144 | 5/1980 | Manabe et al. | 112/121.12 |

*Primary Examiner*—Peter P. Nerbun

*Attorney, Agent, or Firm*—Browdy and Neimark

[57] ABSTRACT

An apparatus for controlling the transverse movement of a fabric supporting carriage in a quilting machine. The carriage is coupled to a d.c. electric motor by a rack and pinion arrangement and the motor is fed by width modulated current pulses having fixed amplitude under control of a programmable processing unit such as a microcomputer.

6 Claims, 4 Drawing Figures

APPARATUS FOR CONTROLLING THE TRANSVERSE MOVEMENT OF A FABRIC SUPPORTING CARRIAGE IN A QUILTING MACHINE

BACKGROUND OF THE INVENTION

The present invention relates to an apparatus for controlling the intermittent and reciprocating movements of a fabric supporting carriage, which is required to carry out stitching lines according to prefixed patterns or designs in a quilting or embroidering machine. Quilting machines perform the stitching according to a particular pattern or design of two or more superimposed fabrics with insulating material therebetween. The product so obtained has several different applications, e.g. in manufacturing bed covers, sleeping bags, mattresses, etc. Such quilting machines include driving rolls for the fabrics and the insulating materials, a fabric-supporting carriage able to move transversally to the advancement direction of said rolls and one or more, vertically movable needle-bearing bars. Stitching is preformed during the time intervals when the fabrics are still, whereas when the needles are lifted, the fabrics are longitudinally advanced by means of the driving rolls and transversally shifted by the reciprocating movements of the fabric-bearing carriage.

A considerable shortcoming of the known cam-operated quilting machines is that only limited sizes and numbers of the stitched design can be obtained because the non-rectilinear stitching is carried out through the composition of the relative advancing movements of the fabric and the lateral movements of the fabric-bearing carriage. Both of these movements are rectilinear and orthogonal with respect to one another and it is therefore obvious that the shape of the stitching and the distances between stitches can only be varied by changing the relative speed of the two movements (and therefore the entity of the movements).

Whereas there is no particular difficulty in controlling the driving rolls the two-way variable-length jerking movement of the fabric-bearing carriage imposes considerable limitations to the performance of the quilting machine.

There are known apparatuses for controlling the carriage employing step by step electric motors (associated with hydraulic systems to increase the torque) or variously shaped cams which effect only a specific movement amplitude and contour. These control systems and shortcomings due to the mounting clearance of cams and rolls, machine noise, wear of the components and above all, a complete lackness of flexibility of the stitching patterns. In fact it is a matter of course that a cam, however accurately designed, cannot be used but for a limited number of stitching patterns even if in combination with sophisticated programming systems which in any case do not avoid the change of the cam for each type of pattern. It is moreover impossible to effect a gradual shift from one shape of stitching to another, there being upper limits for the maximum length of the run and lower limits for the minimum allowable inversion of movement, and finally it is necessary to stock a number of cams suitable to the production requirements.

SUMMARY OF THE INVENTION

The above-mentions disadvantages shortcomings are overcome by the control apparatus of the present invention which provides for a rack and pinion coupling for effecting the movements of the fabric bearing carriage, and a d.c. electric motor directly connected to drive the rack and pinion arrangement.

In order to obtain the desired displacements, the d.c. motor is fed with a prefixed amplitude current for adjustable time intervals. The rack and pinion drive allows one to standardize all the transverse movements, characterizing them only by their amplitude and their transverse direction. Consequently, the system allows a complete freedom in chosing the run lengths, the inversions and the stops of the fabric bearing carriage, eliminating all the mechanical engagement and disengagement devices. This makes possible a machine which is to be controlled by a micro-computer or micro processor which can be programmed in advance or modified when in use whereby in practice all types and shapes of stitch patterns can be obtained in the quilting machine in response to the operator's programs.

The invention provides an apparatus for controlling the transverse movement of a fabric bearing carriage in a quilting machine which includes a rack fixed to the carriage and engaging with a pinion rotated by a d.c. motor, the motor being fed by current pulses having constant amplitude, and duration their polarity depending respectively upon the desired displacement and its direction, supplied by a pulse width modulation (PWM) actuator controlled by a programmable microcomputer, which also controlling the rotation of the rolls advancing the fabric in order to obtain stitching of predetermined pattern or design. The invention is now to be illustrated in a preferred embodiment with reference to the attached drawings.

DESCRIPTION OF A PREFERRED EMBODIMENT

Figure 1:
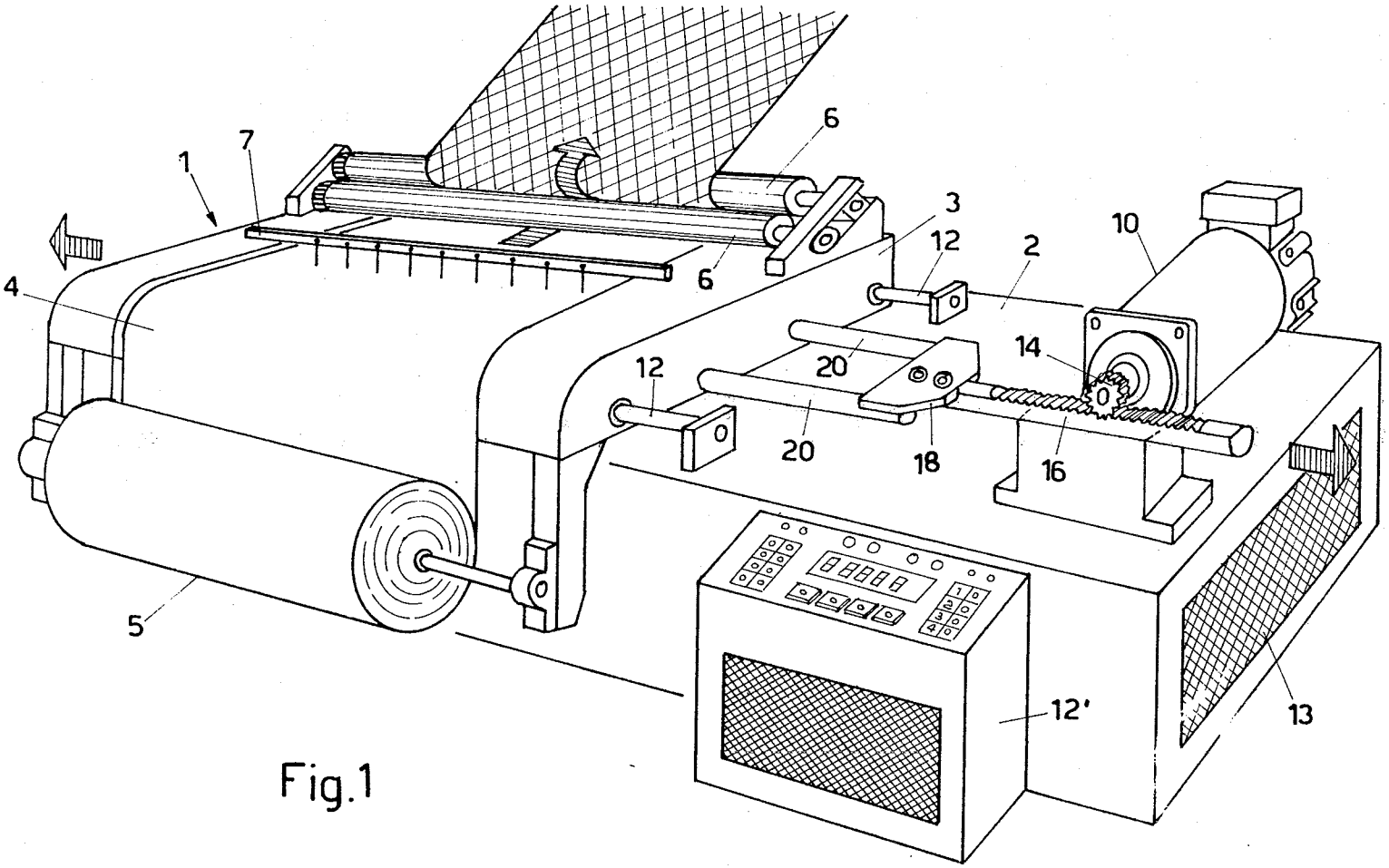
FIG. 1 is a schematic perspective view of a quilting machine incorporating the control apparatus of the present invention.

A quilting machine 1, the main components of which are schematically illustrated in FIG. 1, includes a support table 2 on which a carriage 3 is arranged for the transverse shifting of the fabric fed from one or more rolls 5 and longitudinally advanced by means of driving rolls 6. The quilting machine further includes needle-bearing bars 7 (one of which shown in FIG. 1) suitably connected to an impending frame (comprising also lifting and lowering devices for the needles and not shown) and a d.c. electric motor 10 for effecting transverse movements, as well as management and programming circuits housed in cabinet 12'. For sake of simplicity the drawing does not show the control and driving elements for the rolls as well as the several rolls over which the material to be stitched is wound and also the protecting covering of the members generating the transverse movements has been removed. In working, stitching according to predetermined patterns and designs are accomplished by suitably lowering the needle-bearing bar in the time intervals when the fabric is still, the fabric actually comprising at least two distinct sheets enclosing the padding material, each of the sheets being fed from a roll such as the one designated by reference numeral 5.

The transverse movement of carriage 3 is accomplished by d.c. motor 10 through pinion 14, rack 16, plate 18 and bars 20 along horizontal guides 12.

The movements to be accomplished by the carriage are two way displacements ranging from about 1 mm to several centimeters.

To these displacements there correspond different angular rotations in both directions of motor 10 and gears interposed between the motor and the rack. For simplicity in the FIG. 1, pinion 14 is shown as directly splined to the shaft of motor 10. Angular rotation of motor 10 is obtained by energizing the latter for suitable time intervals upon control of the management and programming circuits in cabinet 12' and through power and control circuits housed in the lower portion 13 of supporting table 2. The working of the machine is now to be described with reference to FIGS. 2 to 4.

Figure 2:
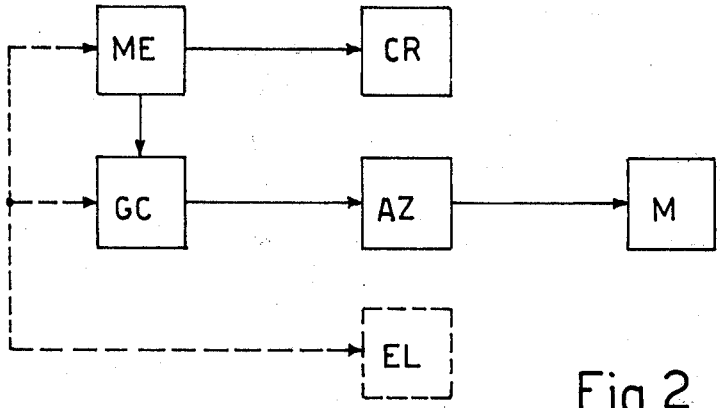
FIG. 2 shows a block diagram illustrating the working of the machine of FIG. 1.
Figure 4:
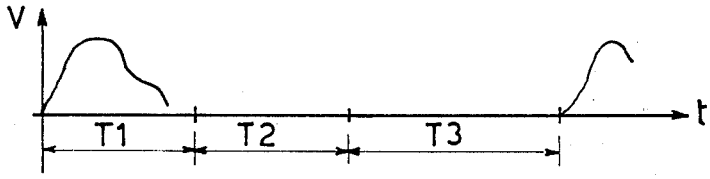
FIG. 4 is a time diagram relating to the working of the invention.

The block diagram of FIG. 2 illustrates a motor M driven by an actuator AZ of the electronic type, controlled by unit GC which in turn is subordinated to a microcomputer ME programmable for controlling both the fabric bearing carriage and the driving rolls (the latter by means of the rolls control unit CR). An exemplary basic cycle for accomplishing a single stitch (referring to each needle) is shown in FIG. 4. It comprises at least three time intervals, respectively T1, T2 and T3. At the starting time, corresponding to the orgin of the t axis, the rolls and the carriage are brought into movement, the needle bearing bars being lifted. After a time T1 the carriage is stopped and after a time T2 the rolls too are stopped. In the remaining part (T3) of the basic interval there occur the lowering and the lifting of the needles together with the further required preparation operations. In the diagram of FIG. 4 on the ordinates axis it is shown the speed of the carriage which must go down to zero within interval T1.

Figure 3:
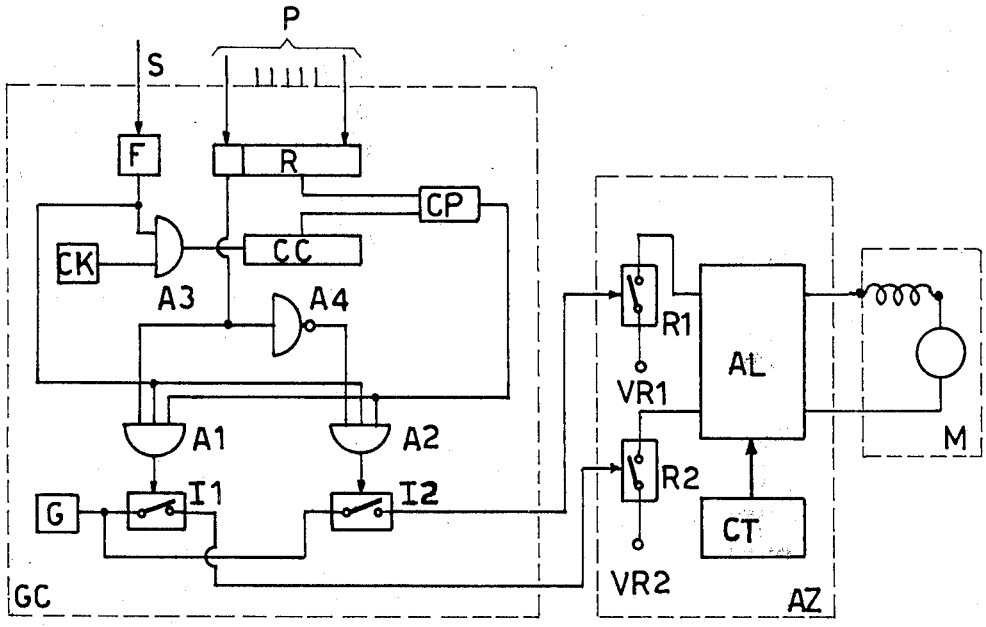
FIG. 3 shows in detail some of the component blocks.

The block diagram of the circuit accomplishing the feeding of the d.c. motor is shown in FIG. 3. The output signal from the microcomputer consists of a synchronizing signal S and of a binary code with sign transmitted through leads P. The binary code on leads P is stored in a register R whereas the synchronizing signal is applied to a flip-flop or bistable circuit F. When the synchronizing signal S appears, e.g. by passing from a logic 0 to a logic 1, AND gate A3 is enabled and clock pulses from a unit CK, also comprising suitable frequency dividers, are fed to counter CC changing its configuration accordingly. At the same time the output of flip-flop F is applied to gates A1 and A2, each having three inputs. Register R and counter CC are connected to the inputs of a comparator CP having the output connected to A1 and A2, the gates also receiving in input the sign bit from R. More particularly the sign bit is fed through inverter A4 to an input of gate A2. Comparator CP compares the code stored in register R with the binary configurations successively present in counter CC, generating a logic 0 upon detecting identity. The outputs of gates A1 and A2 are connected respectively to two electronic switches I1 and I2 supplying a current from a current generator G, respectively to one or the other of the control terminals of switches R1 and R2, for example two dry-reed relays. The closing of switch R1 or R2 causes a reference voltage VR1 or VR2 respectively to be applied to the power supply AL of the electronic actuator AZ for the motor. The feeding of the motor furthermore depends upon safety and check signals, schematically represented by unit CT, to ensure proper operation of the motor.

The working of the circuit shown in FIG. 3 is as set out in the text which follows. Supposing that the displacement required is in a direction characterized by a sign bit equal to 1 and of a length proportional to the bit configuration present on P, when synchronizing signal turns from level 0 to level 1, gate A1 is enabled causing switch I1 to close and a drive current is applied to the winding of relay R1. Reference voltage VR1 being applied to AL, a constant value current having a certain polarity is supplied by power supply AL to the motor in order to effect a movement in the desired direction. The current supply from AL continues until the opening of switch R1, i.e. until the binary content of counter CC is equal to that stored in register R.

At this point in time, the output of comparator CP becomes low blocking gate A1 and causing therefore the opening of switch I1. Of course the time during which the switches were closed in proportional to the value of the binary configuration of program signals on leads P. If a displacement in the opposite direction is required the sign bit will be 0 and thanks to inverter A4 switches I2 and R2 will be closed causing a drive current for the movement in the opposite direction.

Actuator AZ is a conventional one and need not be described in detail as well as motor M which is a series excitated d.c. motor fed by a pulse width modulated current.

From the above it is clear that the running of the motor occurs in jerks, i.e. by swift and exact short rotations in one direction or the other.

Even the stitch length can be controlled by motor 10 and moreover it is possible to check the real displacement of the carriage by means of a feedback loop. In fact, through a unit EL comprising a linear encoder shown in FIG. 2, the real displacement of the carriage can be measured and this information, forwarded to the management control or directly to the microcomputer, is used to correct possible errors with respect to the wished values. Let one suppose for example that a string of stitches each being spaced apart by 2 mm is to be applied and for any reason one of the stitches takes place at 1.5 mm only, then the information of such error in defect from EL will produce a signal to cause the following stitch to be spaced by 2.5 mm, thereby correcting the error of the previous stitch and keeping unchanged the overall lengths of the design which must be kept constant all over the width of the fabric, so that each locally effected stitches in a same design coincides with the ones effected by different needles.

As for the running times of the motor, they depend upon the working speed of the machine and upon the length of the stitches and the design to reproduce. Tipically the base interval made up by T1, T2 and T3 is in the order of about 80 millisec, corresponding to 7,000 jerks/minute for the motor. It is possible to increase the speed up to about 1,000 jerks/minute and to obtain length changes in the order of a few hundredths of millimeter.

Further advantages of the control devices will be described more particularly in the following text.

Practically there are no limits for the carriage run, other than ones imposed by the machine size; there is no limitation for the reverse run of the carriage however short, such as the happens in the known machines using a suitably shaped cam. The complete correspondence between mechanical movements and electric signals allows one to employ a real electronic processor to control the quilting machine, programmed and run directly by the operator who can moreover modify the same through the input/output devices in form of a keybord and visually check over suitable displays in order to obtain particularly complicated stitching patterns, hardly obtainable through conventional controls. The linear relation between the carriage run and the pulse length allows one to realize in a simple way the programs for different stitching patterns even in case they provides for quite variable lengths and directions of the displacements. The control apparatus according to the invention, completely eliminating the change-speed to change the stitch length, allows one to change the length of the stitch from a mininum of 0.2 mm to a maximum of 17 mm with increments in the order of the hundredths of millimeter. Furthermore the number of movements can be increased up to about 1000 per minute, well above the number of a conventional quilting machine. Finally another possible use of the control apparatus according to the invention may be for the longitudinal movement of the fabric, i.e. replacing at least partially the driving rolls with a sub-unit of the carriage longitudinally driven by a rack apparatus according to the invention. This would allow for longitudinal backrunning of the carriage in order to obtain complicated design of the embroidery type.

What I claim is:

1. An apparatus for controlling transverse movement of a fabric supporting carriage in a quilting machine, including driving rolls for longitudinally advancing the fabric, the apparatus comprising a pulse-width modulation actuator; a programmable microcomputer; a pinion, a rack fixed to said carriage, said rack engaging said pinion; a d.c. electric motor having its shaft directly connected to said pinion to rotate same and which is fed current pulses having fixed amplitude but duration and polarity depending respectively upon length and direction of desired displacement of said carriage supplied by said pulse width modulation actuator under control of said programmable microcomputer, said programmable microcomputer being operatively arranged to control advance of said driving rolls for the fabric to obtain stitches according to predetermined designs or patterns.

2. An apparatus according to claim 1, including means for applying two reference voltages for predetermined time intervals to said actuator to generate the current pulses.

3. An apparatus according to claim 2, wherein said sources supplying the reference voltages are connected to inputs of actuator power supply through two electronic switches under control of one or the other of two control signals for a duration proportional to length of desired carriage displacement.

4. An apparatus according to claim 3 wherein each of said two electronic switches comprises a dry-reed relay connected to a current generator through a corresponding electronic switch controlled by a decoding and comparison circuit.

5. An apparatus according to claim 4 wherein the decoding and comparison circuit includes a register for storing a binary configuration containing the information about the displacement, a counter enabled to count clock pulses by a synchronizing signal and a comparator that, upon detecting identity of the binary configurations stored in the register and in the counter, opens the one of the two electronic switches previously closed by said synchronizing signal.

6. An apparatus for controlling a fabric supporting carriage according to claim 5 further comprising a unit having a linear encoder measuring the real displacement of the carriage, said unit emitting a binary code with sign when detecting an error with respect to the desired displacement which is added to or subtracted from the binary code of the subsequent displacement in order to correct an error in excess or in defect of the carriage displacement.

* * * * *